United States Patent [19]

Howard

[11] Patent Number: 4,586,406

[45] Date of Patent: May 6, 1986

[54] EXTENSIBLE WRENCH CONSTRUCTION

[76] Inventor: Willis H. Howard, 7940 S. 10th East, Sandy, Utah 84070

[21] Appl. No.: 652,277

[22] Filed: Sep. 20, 1984

[51] Int. Cl.[4] ..... B25G 1/04

[52] U.S. Cl. ..... 81/177.2; 403/109

[58] Field of Search ..... 403/107, 108, 109; 81/177.2

[56] References Cited

U.S. PATENT DOCUMENTS

| | | | |
|---|---|---|---|
| 2,705,119 | 3/1955 | Ingwer | 403/108 |
| 2,963,930 | 12/1960 | Clothier et al. | 81/177.2 |
| 3,306,639 | 2/1967 | Lyon | 403/109 |
| 4,169,687 | 10/1979 | Schull | 403/109 |

FOREIGN PATENT DOCUMENTS

| | | | |
|---|---|---|---|
| 250983 | 6/1948 | Switzerland | 403/107 |

*Primary Examiner*—Frederick R. Schmidt
*Assistant Examiner*—Bradley I. Vaught
*Attorney, Agent, or Firm*—M. Ralph Shaffer

[57] ABSTRACT

An improved wrench construction wherein a telescoping handle is extensible and retractable for varying the torque applied to a given work piece such as a nut. The handle of the wrench telescopes a wrench shaft, the two in combination being combined with a quick-release mechanism for easily changing the handle setting from one over-all length to another. In a preferred form of the invention, the wrench is supplied with parallel elongate detent pins that cooperate with grooves in the wrench shaft; these detent pins are lifted rearwardly and outwardly from a particular groove within which they are aligned, by a suitable actuatable sleeve, the essential distance of sleeve travel, relative to pin disengagement from a particular groove, being greater than pin travel out of a particular shaft slot.

3 Claims, 8 Drawing Figures

EXTENSIBLE WRENCH CONSTRUCTION

FIELD OF INVENTION

This invention pertains to wrenches, and more particularly, through an improved wrench structure the handle of which is extensible and withdrawable and provided with locking structure for locking the degree of extension desired.

DESCRIPTION OF PRIOR ART

Certain patents are known which relate to the invention so far as the general concept of extensible handle tools are concerned. These are as follows:

| U.S. Pat. Nos. | |
|---|---|
| 2,382,291 | 2,964,981 |
| 2,592,978 | 3,583,715 |
| 2,677,562 | 3,552,758 |
| 2,869,410 | 3,762,732 |
| Foreign Patents | |
| 477,320 | |

All of the above patents are or may be related to the invention herein so far as the employment of quick-releases and extensible handle tools are concerned in general. However, none of these patents discloses, taken either singly or in combination, the applicant's claimed structure, particularly as relates to the employment of parallel detent pins disposed in slots on opposite sides of a handle body, and wherein such pins are actuated, for shaft groove release, by a suitable sleeve mechanism that can operate in its effective stroke a greater distance than the movement of the detent pins relative to shaft groove depth. Thus, a positive actuation of substantial length is needed relative to the sleeve in order to produce detent pin disengagement with a shaft groove; thus, groove depth can be substantially reduced relative to shaft diameter, thereby preserving shaft integrity and strength.

BRIEF DESCRIPTION OF THE INVENTION

A general description is found at the last portion of the paragraph immediately above. In addition, and in brief summary, the wrench herein has an extensible handle. This takes the form of a grooved shaft affixed to or articulated with respect to the head of the wrench, the shaft fitting into the extensible handle. A sleeve is provided and is constructed so that the sleeve can be actuated by the same hand as that which the user is employing to hold the wrench handle at any particular time. Thus, the remaining hand remains free for independent use. A compression spring and washer combination operate to thrust the detent pins forwardly and inwardly to engage a particular shaft slot aligned therewith. Suitable retainer means are supplied the forward portion of the sleeve. When the user wishes to select a new shaft position relative to the handle, then the user simply depresses rearwardly the sleeve so as to urge the retainer pins rearwardly and outwardly relative to the shaft groove that they formally engaged. The wrench shaft is then slipped further into or out of the handle so as to obtain a new torque position, lengthening or shortening of the effective handle of the wrench relative to its head.

OBJECTS

Accordingly, a principal object of the present invention is to provide a new and improved extensible wrench.

An additional object is to provide a wrench wherein a particular handle-wrench setting is positive and secure, and which can be adjusted only by virtue of a definite axial translation of the spring-biased sleeve employed in the wrench, this even though but a slight movement of the detent pins provided the wrench in connection with shaft retention be needed.

A further object is to provide an extensible wrench having a quick-release mechanism of the type wherein positive and definitive movement of control means is required in order to release the handle-wrench detent provided.

An additional object is to provide a wrench wherein the same can be adjusted for maximum torque and also minimum lever arm simultaneously and without handle adjustment relative to the grooved shaft received by the same.

BRIEF DESCRIPTION OF DRAWINGS

The features of the present invention which are believed to be novel are set forth with particularity in the appended claims. The present invention, both as to its organization and manner of operation, together with further objects and advantages thereof may best be understood by reference to the following description, taken in connection with the accompanying drawings in which:

BRIEF DESCRIPTION OF PREFERRED EMBODIMENTS

Figure 1:
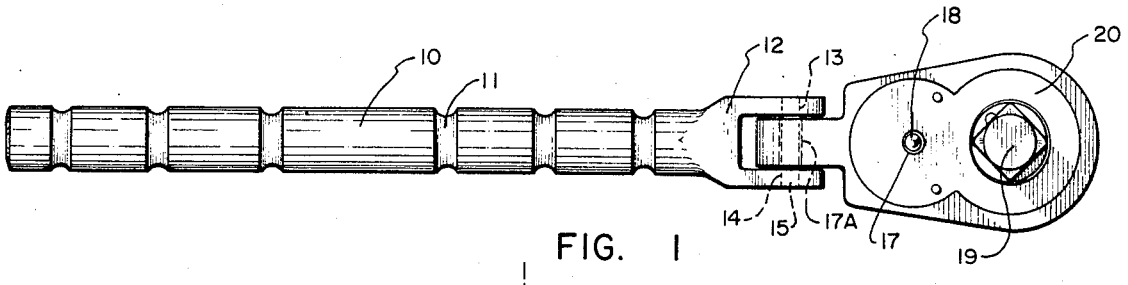
FIG. 1 is a bottom plan of a portion of a wrench construction utilizing the present invention.

Each of the wrenches of the invention will include an inner shaft 10 having mutually spaced annular grooves 11. In FIG. 1, the shaft 10 terminates in a clevis 12 which is provided with apertures 13 and 14 for receiving pin 15. Pin 15 is a pivot for head 16, the latter being provided with interior enlarged aperture 17A. Head 16 is of the usual form in connection with conventional, ratchet-type socket wrenches as is manufactured for the Sears Company, for the Snap-On Tool Corporation, and so forth. It is conventional that the head 16 will include a ratcheting, pawl and ratchet-wheel mechanism with a ratchet control 17 having ratchet control pin 18. The ratchet control 17 is likewise of standard construction and forms no part of the invention of itself. Likewise provided is the usual socket engagement end 19, e.g., for ¼", ⅜", and ½" socket fittings, which proceeds through an appropriate aperture in the cover plate 20, also of conventional form and construction. The handle 28, is longitudinally adjustable, see FIG. 6, and is fitted over the inner shaft 10 of the structure of FIG. 1 in a conventional manner later to be described.

The ratcheting control, and engagement and disengagement effected by the structure 17 and 18 is conventional and co-acts with socket engagement end 19 in the usual manner. The dotted-line orientation of shaft 10 in FIG. 2 illustrates shaft orientation parallel to fitting 19, useful, for example, in rapidly removing loosened spark plugs from engines.

Figure 2:
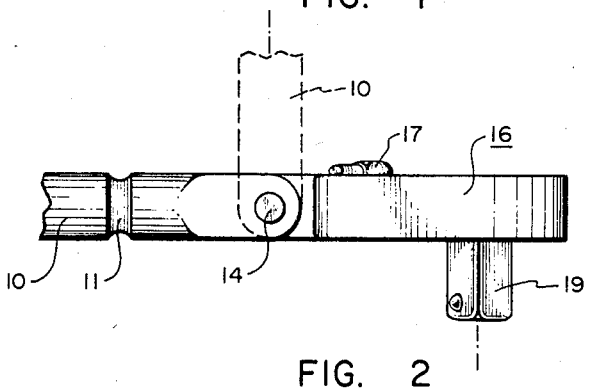
FIG. 2 is a side elevation of a portion of the structure of FIG. 1 when inverted, the dotted line configuration of the shaft illustrating an elevation of the wrench shaft and its handle so that the same are parallel to an offset relative to the socket fitting of the wrench.
Figure 3:
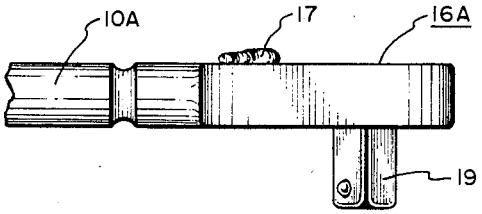
FIG. 3 is similar to FIG. 2 but illustrates the head of the wrench as being integral with its shaft rather than articulatively joined thereto as seen in FIGS. 1 and 2.

FIG. 3 is similar to the structure shown in FIGS. 1 and 2 with the exception that the head 16A, corresponding to head 16 in FIG. 1, is fixed and integral relative to shaft 10A corresponding to shaft 10 in FIG. 1. In other words, the swivel or hinge-type structure as at 14 in FIGS. 1 and 2 is simply absent in FIG. 3. The handle 28, when used, will slip over the shaft 10A in a manner similar to the slippage relative to shaft 10 as will be here and after set forth.

Figure 4:
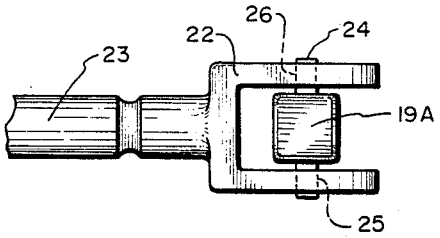
FIGS. 4 and 5 are top plan and side elevation view of an alternate wrench construction of the flex-handle wrench design, this where the wrench handle is pivoted and pivotally secured to the socket tip or socket engagement end of the wrench.
Figure 5:
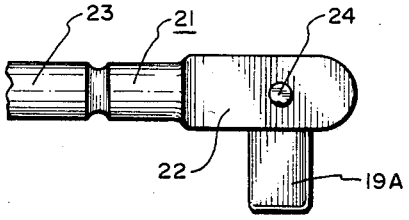

FIGS. 4 and 5 illustrate yet another form of wrench that can employ the present invention. This time, the wrench is provided with clevis 22 and the shaft 23 corresponding to shaft 10 in FIG. 1. The socket engagement end 19A, this time, instead of having a ratcheting mechanism, is simply provided with a pin 24 that passes through apertures 25 and 26 of the clevis. Accordingly, the end is free to move relative to the handle as shown in FIG. 5. Where the socket engagement end 19A in FIG. 5, corresponding to end 19 in FIG. 1, is considered in the vertical position, then the handle, later to be shown, will move in a horizontal plane.

It is conceivable that open-end or even other types of wrenches can employ this invention.

Figure 6:
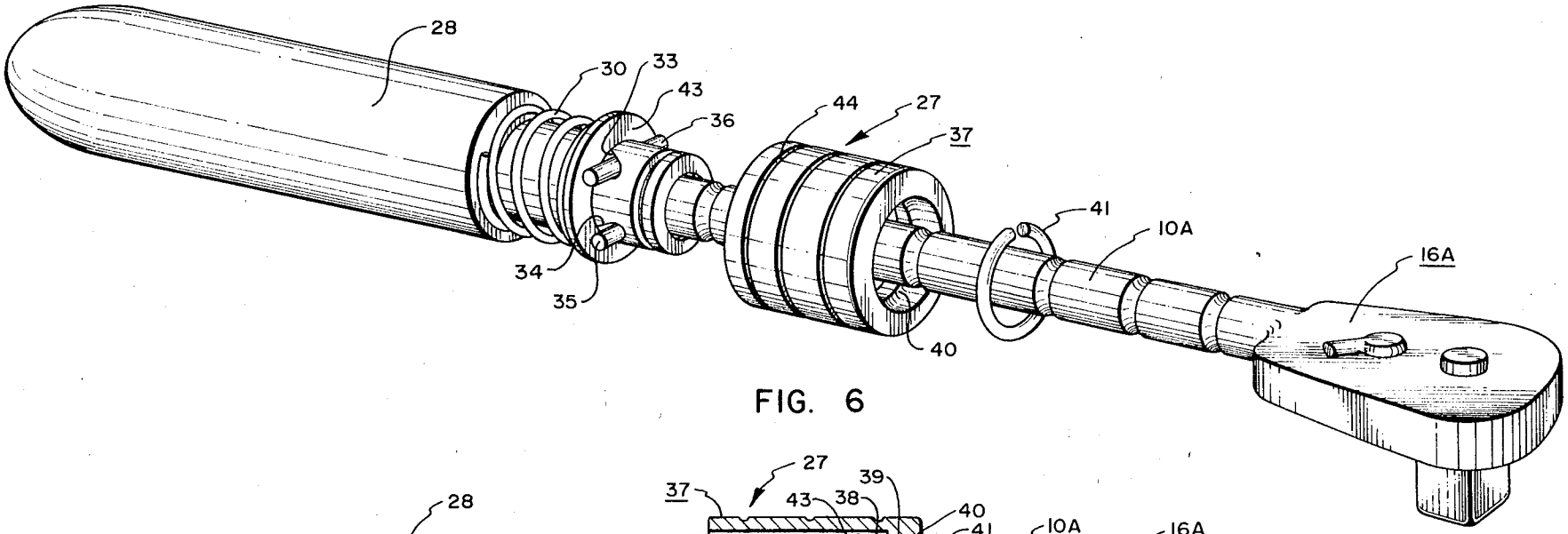
FIG. 6 is an enlarged perspective view of the wrench of the present invention in a preferred embodiment thereof as the same is being assembled, the sleeve provided being in a position for urging rearwardly immediately prior to securement of a snap ring to the reduced forward body of the handle of such wrench.
Figure 7:
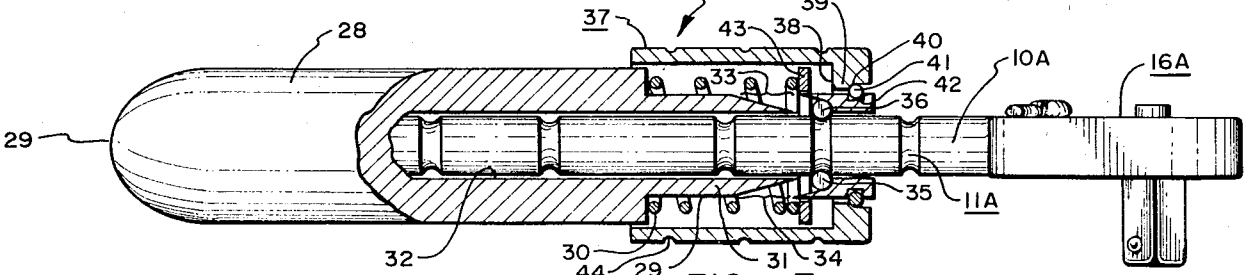
FIG. 7 is a side elevation, partially cut away in section for convenience of illustration, of the assembled wrench of FIG. 6 when the horizontal detent pins on opposite sides of the grooved shaft of the wrench are disposed in alignment and also in engagement with a particular groove of the shaft.
Figure 8:
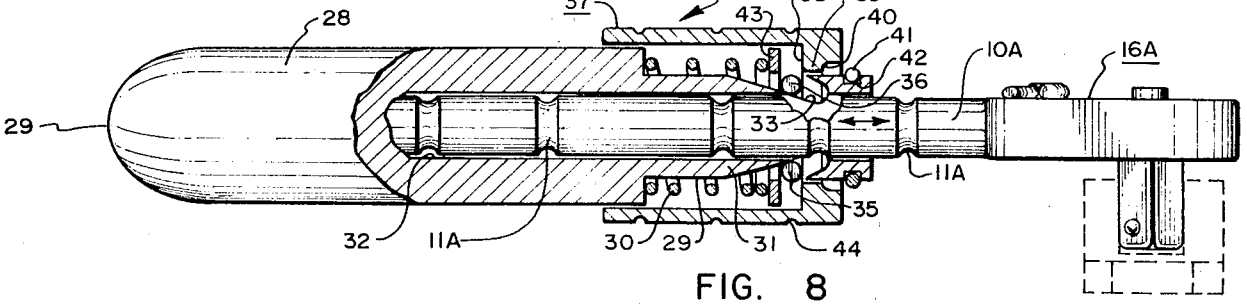
FIG. 8 is similar to FIG. 7 but illustrates a rearward urging of the sleeve so as to displace the detent pins rearwardly and outwardly of their slots, thus effecting a release as between the pins and the groove with which they were formally engaged, this for the purpose of permitting the user to draw outwardly the wrench shaft to a new position relative to the handle or, alternatively, to push the same inwardly as the case may be, for a new overall effective wrench length as desired in connection with space and/or torque considerations.

In FIGS. 6–8 handle 28 of wrench 27 is preferably fabricated from stainless steel and includes a rounded end, for hand comfort. Handle 28 is provided with bore 32 that slidably but tightly receives shaft 10 having work end 16A. Mutually spaced shaft grooves 11A are provided but are of shallow depth in order to preserve shaft strength. Handle 28 also includes a forward body portion 31 of reduced cross-sectional dimension and which forms a shoulder against which the left-end of compression spring 30 abuts, such spring being disposed over body surface 29.

Body portion 31 has a pair of rearwardly and outwardly angulated, bottomed slots 33 and 34 which intersect handle bore 32. Movably disposed in said slots are detent pins 35 and 36. Washer 43 is disposed between and engages said pins and the forward or right end of compression spring 30. It is possible that the spring 30 could contact the pins 35, 36 direcly. In any event control sleeve 37 is provided and is locked in place by retainer ring 41, nestling between sleeve forward shoulder 40 and groove 42 of reduced body portion 31. Rear shoulder 38 of flange 39, of the control sleeve 37, abuts the forward surfaces of the opposite outer extensions of pins 35, 36.

In assembly as to FIG. 6, control sleeve 37 is advanced rearwardly by snap ring retainer fitting into groove 42 of body portion 31.

In releasable fixed setting, see FIG. 7, detent pins 35, 36 engage a particular shaft groove 11A and secure the shaft to the handle in one handle-shaft setting. The spring 30 thrusts against washer 43 which in turn thrusts against the outer opposite extremities of the detent pins 35, 36, to keep these pins in a chosen groove 11A.

In FIG. 8 as to operation, when a new shaft-handle setting is desired, control sleeve 37 is displaced rearwardly as shown, releasing the engagement of detent pins 35, 36 with prior chosen groove 11A. The upper and outer, opposite movements of the pins 35, 36 follows the necessarily pronounced positive rearward displacement of the sleeve, thus enabling the employment of shallow-depth grooves in shaft 10A so as to preserve shaft depth. The shaft is now free to be moved axially, as shown by the double-headed arrow, until a new groove 11A nominally is aligned with the pins, at which point the control sleeve is released and the pins 35, 36 positively engage the new groove 11A for a new handle-shaft setting.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

I claim:

1. A wrench construction including, in combination: a handle having an axial bore, a medial forwardly-facing reaction shoulder, and a forward body portion of reduced dimension and extending forwardly of said reaction shoulder, said forward body portion including a pair of transverse dimetrically oppositely disposed forwardly undercut slots intersecting said bore and oppositely angulated rearwardly and outwardly; an elongate shaft slidably disposed in said bore of said handle and provided with a work-performing head, said shaft having a plurality of mutually spaced annular grooves; a pair of detent pins laterally slidably disposed in respective ones of said slots and releasably seated in a selected one of said grooves; compression coil spring means surrounding said forward body portion and operably disposed between and acting upon said reaction shoulder and said detent pins; and manually operable sleeve means surrounding said spring means engaging said detent pins, and being spring-biased by said compression coil spring means in a direction along the longitudinal axis of said handle, for urging said detent pins in respective angulated rearward and outward directions within said slots against the bias of said compression coil spring means, whereby to effect, through pronounced rearward longitudinal movement of said sleeve means, an unlocking disengagement between said detent pins and said selected one of said grooves, and thereby permit said shaft to be longitudinally moved and reset, relative to said handle, for a new lock of said detent pins, under the pressure of said compression coil spring means when said sleeve means is manually released, relative to another one of said grooves of said shaft, said compression coil spring means biasing said sleeve means against said detent pins.

2. A wrench construction including, in combination: a handle having an axial bore, a medial forwardly-facing reaction shoulder, and a forward body portion of reduced annular dimension and extending forwardly of said reaction shoulder, said forward body portion including a pair of transverse diametrically oppositely disposed forwardly undercut slots intersecting said bore and oppositely angulated rearwardly and outwardly; an elongate shaft slidably disposed in said bore of said handle and provided with a work-performing head, said shaft having a plurality of mutually spaced annular grooves; a pair of detent pins laterally slidably disposed in respective ones of said slots and releasably seated in a selected one of said grooves; compression coil spring means mounted over said forward body portion and operably disposed between and acting upon said reaction shoulder and said detent pins; a centrally apertured washer surrounding said forward body portion and disposed between said compression coil spring means and said detent pins; and manually operable sleeve means engaging said detent pins, and being spring-biased by said compression coil spring means in a direction along the longitudinal axis of said handle, for urging said detent pins in respective angulated rearward and outward directions within said slots against the bias of said compression coil spring means, whereby to effect, through pronounced rearward longitudinal movement of said sleeve means, an unlocking disengagement between said detent pins and said selected one of said grooves, and thereby permit said shaft to be longitudinally moved and reset, relative to said handle, for a new lock of said detent pins, under the pressure of said compression coil spring means when said sleeve means is manually released, relative to another one of said grooves of said shaft, said compression spring means biasing said sleeve means against said detent pins.

3. A wrench construction including, in combination: an elongate shaft with mutually spaced grooves and provided with a work-performing head, adjustable handle means telescopingly receiving said shaft for selectively altering the torque supplied said head, said handle means having a forward, reduced-diameter body portion provided with side-opposite, forwardly-and inwardly-oriented undercut slots, and said handle means being provided with quick-release means for releasably locking said handle means onto said shaft in one of a selectable number of longitudinally-spaced positions; said quick-release means comprising: a longitudinally-movable actuatable sleeve surrounding said body portion, a compression-type coil spring means surrounding said body portion and cooperable with and longitudinally biasing said actuatable sleeve, and plural, angulated-travel, pin-type detent means engaging said sleeve and cooperable with said handle and respectively riding in said undercut slots against the compression of said spring means and movable and engaged by said sleeve for selectively releasing a detent-lock between said handle and a respective one of said shaft grooves, prepatory to axial movement of said shaft relative to said handle for a new detent-lock therebetween.

* * * * *